US011891820B2

(12) United States Patent
Li

(10) Patent No.: US 11,891,820 B2
(45) Date of Patent: Feb. 6, 2024

(54) DECORATING TOOL

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 490 days.

(21) Appl. No.: 17/266,611

(22) PCT Filed: Dec. 24, 2020

(86) PCT No.: PCT/CN2020/138933
§ 371 (c)(1),
(2) Date: Feb. 7, 2021

(87) PCT Pub. No.: WO2022/133882
PCT Pub. Date: Jun. 30, 2022

(65) Prior Publication Data
US 2022/0412103 A1 Dec. 29, 2022

(51) Int. Cl.
*E04F 21/16* (2006.01)
*E04F 21/24* (2006.01)

(52) U.S. Cl.
CPC ..... *E04F 21/16* (2013.01); *E04F 21/24* (2013.01)

(58) Field of Classification Search
CPC ..... E04F 21/02; E04F 21/165; E04F 21/1652; E04F 21/1655; E04F 21/10; E04F 21/16; E04F 21/24; E04F 21/241; E04F 21/244; E04F 21/245; A01B 1/225
See application file for complete search history.

(56) References Cited

U.S. PATENT DOCUMENTS 2,976,612 A * 3/1961 March ..... A01G 20/30 30/318
4,219,899 A * 9/1980 Zurawin ..... B05C 17/00 15/210.1
7,010,828 B1 * 3/2006 Flores, Sr. ..... E01C 23/025 15/235.4
7,396,187 B1 * 7/2008 Meyers ..... A47G 27/0487 16/110.1
7,854,037 B2 * 12/2010 Lu ..... B05C 17/00 15/210.1

(Continued)

FOREIGN PATENT DOCUMENTS

CN 201542475 U 8/2010
CN 211817718 U 10/2020

(Continued)

OTHER PUBLICATIONS

International Search Report of PCT/CN2020/138933.

*Primary Examiner* — Thu Khanh T. Nguyen

(57) ABSTRACT

The present claims a decorating tool, comprising a working portion, a grip portion and a connecting portion. The working portion and the grip portion are connected to two ends of the connecting portion, respectively. The connecting portion is configured for controlling the grip portion to rotate towards or away from the working portion. The grip portion can be rotated to adjacent to a sidewall of the working portion, and not protrude from two ends of the working portion.

17 Claims, 7 Drawing Sheets

(56) References Cited

U.S. PATENT DOCUMENTS 9,885,189 B2 * 2/2018 Ethier ..... E04F 21/161

FOREIGN PATENT DOCUMENTS

| | | | |
|---|---|---|---|
| CN | 212053637 | A | 12/2020 |
| DE | 20308175 | A | 9/2003 |
| FR | 2837228 | A | 9/2004 |
| JP | 322118 | A | 5/2019 |

* cited by examiner

DECORATING TOOL

CROSS-REFERENCE TO RELATED APPLICATION

This application is a 371 of international of PCT patent application PCT/CN2020/138933 filed on Dec. 24, 2020, the content of which is hereby incorporated by reference.

TECHNICAL FIELD

The present disclosure relates to tools, and in particular to a decorating tool.

BACKGROUND

A decorating tool can smooth or temporarily cover a wall surface of a building, a garden or a courtyard. The conventional decorating tool includes a working portion, a grip portion, and a connecting structure between the working portion and the grip portion. The connecting structure is in a fixed position between the working portion and the grip portion and is not adjustable. This decorating tool also requires more space to be orderly stored, which can reduce the quantity of decorating tools that can be transported. In addition, this structure cannot meet a requirement for adjusting the relative position of the working portion and the grip portion in certain operating situations.

SUMMARY

The present disclosure provides a decorating tool, including a working portion, a grip portion and a connecting portion. The working portion and the grip portion are connected to two ends of the connecting portion, respectively. The connecting portion is configured for controlling the grip portion to rotate towards or away from the working portion. The grip portion can be rotated to adjacent to a sidewall of the working portion, and not protrude from two ends of the working portion.

Furthermore, a first end of the connecting portion is connected to a middle part of the sidewall of the working portion, and a length of the grip portion is half a length of the side of the working portion. Therefore, the grip portion can be rotated to a position at which the grip portion is perpendicular to the working portion to define a T-shape symmetric structure, so that it can be more convenient to use. In addition, the grip portion can be rotated to adjacent to the working portion, so that the decorating tool is more compact when it is not used, and more convenient to store.

Furthermore, the connecting portion has a locking state and an unlocking state, wherein when the connecting portion is in the unlocking state, the grip portion is capable of rotating towards or away from the working portion; and when the connecting portion is in the locking state, the grip portion is fixed with the working portion. Therefore, the decorating tool has an adjustable structure when the connecting portion is in the unlocking state, and has a fixed structure when the connecting portion is in the locking state. A user can adjust a relative position between the working portion and the grip portion and an angle defined by the working portion and the grip portion, to make the working portion and the grip portion locked with each other, thereby using the decorating tool more conveniently.

Furthermore, the connecting portion includes a first locking portion, a second locking portion and a first adjusting unit. The first locking portion and the second locking portion are connected to the working portion and the grip portion, respectively. The first adjusting unit is movably connected to the first locking portion and the second locking portion. The first adjusting unit at least has a first adjustable position and a second adjustable position. When the first adjusting unit is at the first adjustable position, the first locking portion and the second locking portion mesh with each other to define the locking state. When the first adjusting unit is at the second adjustable position, the first locking portion and the second locking portion do not mesh with each other to define the unlocking state. Therefore, when the user wants to adjust the relative position between the working portion and the grip portion, the connecting portion can be adjusted the unlocking state and a meshing between the first locking portion and the second locking portion can be released. After adjusting the relative position between the working portion and the grip portion, the connecting portion can be adjusted to the locking state. The first locking portion can mesh with the second locking portion, so that the locking between the grip portion and the working portion is more firmly. The connecting portion will not damage even after using for a long time, so that the decorating tool is durable.

Furthermore, the first locking portion is opposite to the second locking portion. A side of the first locking portion near the second locking portion is provided with a first set of teeth. A side of the second locking portion near the first locking portion is provided with a second set of teeth, which matches with the first set of teeth. The first adjusting unit includes a first connecting shaft and a first adjusting member. The first connecting shaft penetrates through the first locking portion and the second locking portion. The first adjusting member is movably connected to the first connecting shaft, and capable of moving relative to the first connecting shaft, so that the first locking portion and the second locking portion can be tightly mesh with each other, resulting in defining the locking state. Or, the first locking portion can be separated from the second locking portion, and the locking state between the first locking portion and the second locking portion is released, resulting in defining the unlocking state. Therefore, the user can adjust the relative position between the first adjusting member and the first connecting shaft, so that the first adjusting unit can switch between the first adjustable position and the second adjustable position. When the first adjusting unit is at the first adjustable position, the first locking portion can move towards the second locking portion along an axial line of the first connecting shaft to mesh with the second locking portion and define the locking state. When the first adjusting unit is at the second adjustable position, the first locking portion can move away from the second locking portion along the axial line of the first connecting shaft and the locking state between the first locking portion and the second locking portion can be released.

Furthermore, the first adjusting member is sleeved on the first connecting shaft and threadedly connected to the first connecting shaft. The first adjusting member is capable of moving along the axial line of the first connecting shaft, so that the first locking portion and the second locking portion are tightly connected or separated from each other. Therefore, the first adjusting unit has a simple structure and a simple connection type, so that the user can adjust the first adjusting member to switch between the first adjustable position and the second adjustable position by rotating the first adjusting member.

Furthermore, the first adjusting member is pivotally connected to the first connecting shaft. The first adjusting member includes a first protrusion. The first adjusting member is capable of rotating relative to the first connecting shaft and driving the first protrusion to push the first blocking portion and the second blocking portion, so that the first locking portion and the second locking portion can be tightly meshed with each other. Or, the first adjusting member can drive the first protrusion to move away from the first locking portion or the second locking portion, so that the first locking portion is separated from the second locking portion. Therefore, the adjusting process of the first adjusting unit will be simpler. The first protrusion is driven by the first adjusting member to press or stop pressing the first locking portion and the second locking portion, so that it costs few time to switch a position of the first adjusting unit between the first adjustable position and the second adjustable position.

Furthermore, the first adjusting unit further includes a first elastic member. The first connecting shaft includes a plug portion and a first limiting portion which is connected to an end of the plug portion. An outer diameter of the first limiting portion is larger than that of the plug portion. A first end of the first elastic member abuts against the first limiting portion, and a second end of the first elastic member abuts against the first locking portion or the second locking portion. Therefore, when the first adjusting unit is at the first adjustable position, the first elastic member and the first limiting portion can work together to increase pressure between the first locking portion and the second locking portion, so as to strengthen the meshing between the first locking portion and the second locking portion.

Furthermore, the first adjusting unit further includes a gasket and a second elastic member. The second elastic member and the first elastic member have different elastic coefficients. The first elastic member, the gasket and the second elastic member are successively sleeved on the first connecting shaft. The second end of the first elastic member abutting against the first locking portion or the second locking portion is away from the second elastic member, an end of the second elastic member away from the first elastic member abuts against the first limiting portion. Therefore, when the first locking portion meshes with the second locking portion, the first elastic member and the second elastic member work together to further increase the pressure between the first locking portion and the second locking portion. When switching the first adjusting unit from the first adjustable position to the second adjustable position, the user will overcome a larger elastic force than the pressure between the first locking portion and the second locking portion meshing with each other. This can avoid unlocking caused by accidental interference.

Furthermore, the first locking portion or the second locking portion is provided with an accommodation groove. The first elastic member, the gasket, the second elastic member and the first limiting portion are accommodated in the accommodation groove. Therefore, the connecting portion can have a smaller size. At the same time, the first elastic member, the gasket and the second elastic member can be better protected by the accommodation groove.

Furthermore, the first adjusting member further includes a second protrusion. The second protrusion and the first protrusion are located at a same side of the first adjusting member. The second protrusion is configured for limiting rotation of the first locking portion relative to the second locking portion when the first locking portion is tightly meshed with the second locking portion. Therefore, both the second protrusion and the first protrusion can press on the first locking portion or the second locking portion, and improve the stability of the first adjusting member when abutting against the first locking portion or the second locking portion, so as to prevent the first protrusion from sliding relative to the first locking portion or the second locking portion when the first protrusion independently abuts against the first locking portion or the second locking portion, thereby ensuring pressing and locking of the first locking portion and the second locking portion.

Furthermore, the first adjusting member further includes a warping portion, which is located at an end of the first adjusting member away from the first protrusion, and the warping portion bents along a direction opposite to the first protrusion. Therefore, the warping portion can be more convenient for the user to grip, so that the user can pull the first adjusting member more conveniently.

Furthermore, the first locking portion is provided with a first through hole, and a third set of teeth is disposed on an inner wall of the first through hole. The second locking portion is provided with a second through hole, and a fourth set of teeth is disposed on an inner wall of the second through hole. The first adjusting unit includes a locking member penetrating through the first through hole and the second through hole. A fifth set of teeth is disposed on an outer surface of the locking member. The locking member is capable of moving in the first through hole and the second through hole along an axial line of the first through hole and the second through hole, so that the fifth set of teeth mesh with both the third set of teeth and the fourth set of teeth at the same time to define the locking state. Or, the fifth set of teeth does not mesh with the third set of teeth and the fourth set of teeth to define the unlocking state. Therefore, the locking member can move inside the first through hole and the second through hole, so as to switch the position of the first adjusting unit between the first adjustable position and the second adjustable position. In addition, the meshing between the fifth set of teeth and the third set of teeth or between the fifth set of teeth and the fourth set of teeth can be switched by changing the position of the locking member relative to the first locking portion and the second locking portion.

Furthermore, the locking member includes a locking section and a smooth section. The fifth set of teeth is located on an outer surface of the locking section. The locking state is defined when the locking section of the locking member is arranged through the first through hole and the second through. The unlocking state is defined when the smooth section of the locking member is arranged through the first through hole and/or the second through hole. Therefore, when the user wants to unlock the connecting portion, the locking section of the locking member should be entirely separated from at least one of the first through hole and the second through hole, or the smooth section entirely penetrated through at least one of the first locking portion or the second locking portion. When the user wants to lock the connecting portion, the fifth set of teeth of the locking section should entirely or partly mesh with the third set of teeth and the fourth set of teeth.

Furthermore, the first adjusting unit further includes a pressing member and a third elastic member, the pressing member is fixed to an end of the smooth section away from the locking section. A first end of the third elastic member is connected to the first locking portion or the second locking portion. A second end of the third elastic member opposite to the first end is configured for pushing the fifth set of teeth to mesh with both the third set of teeth and the fourth set of teeth at the same time by an elastic thrust. Therefore, in a normal state that the user does not press the first adjusting unit, the third elastic member cooperates with the pressing member to make the first locking portion and the second locking portion locked throughout, so as to ensure the grip portion being fixed relative to the working portion while using the decorating tool. When the user wants to adjust the relative position of the working portion and the grip portion and the angle defined by the working portion and the grip portion, the first locking portion and the second locking portion can be unlocked as long as the user presses the pressing member with enough force which is larger than the elastic force of the third elastic member.

Furthermore, the connecting portion includes a second adjusting unit. The connecting portion is connected to the working portion via the second adjusting unit. The second adjusting unit is configured for adjusting a working angle of the decorating tool. Therefore, the applicability of the decorating tool is further improved. The working angle of the decorating tool can be adjusted to meet with requirement of workplaces with different shapes.

Furthermore, the second adjusting unit includes a clamping member, a second connecting shaft, and a second adjusting member. The working portion further includes a supporting portion. The clamping member is sleeved on an outer surface of the supporting portion, and capable of rotating around the supporting portion. One of the clamping member and the supporting member is provided with a third through hole, the other one of the clamping member and the supporting member is provided with a slot along a circumference of the supporting portion, and the second connecting shaft penetrates through the third through hole and the slot. The second adjusting member is movably connected to the second connecting shaft and capable of moving relative to the second connecting shaft, so that the second connecting shaft is capable of moving in the slot and being fixed to different positions of inner wall of the slot. Therefore the second adjusting unit has a locking state and an unlocking state. When the second adjusting unit is in the locking state, the clamping member and the supporting portion are tightly pressed and fixed to each other. When the second adjusting unit is in the unlocking state, the fixing between the clamping member and the supporting portion are released. The working angle of the decorating tool can be conveniently and quickly switched by changing the locking state and unlocking state between the second adjusting unit and the working portion.

Furthermore, the supporting portion is provided with a plurality of third through holes, and the plurality of third through holes are arranged along an axial line of the supporting portion. Alternatively, the supporting portion is provided with a plurality of slots, and the plurality of slots are arranged along an axial line of the supporting portion. Therefore, the user can adjust the installation position of the clamping member along the axial line of the supporting portion to further adjust the installation position of the grip portion on the working portion, thereby meeting different requirements of users using the decorating tool in different workplace.

The decorating tool in present disclosure has following advantages compared with the conventional decorating tool. In the present disclosure, a decorating tool is provided with a connecting portion, which defines an adjustable structure between the working portion and the grip portion. The grip portion can be rotated towards the working portion to define an accommodation state of the decorating tool, so that the decorating tool can be orderly stored and occupy a smaller space, thereby increasing the quantity of the decorating tools that can be transported within the same volume. The decorating tool can also meet a requirement of adjusting the relative position between the grip portion and working portion in some workplaces and enlarge a range of application of the decorating tool. The grip portion can be rotated towards the working portion to form the accommodation state of the decorating tool. When the decorating tool is in the accommodation state, the decorating tool has a regular shape and occupies a smaller space, which facilitates storing in order.

BRIEF DESCRIPTION OF THE DRAWINGS

In order to better describe and explain the embodiments and/or examples of those inventions disclosed herein, one or more drawings may be referred to. The additional details or examples used to describe the drawings should not be considered as limiting the scope of any of the disclosed inventions, the currently described embodiments and/or examples, and the best mode of these inventions currently understood.

Figure 1:
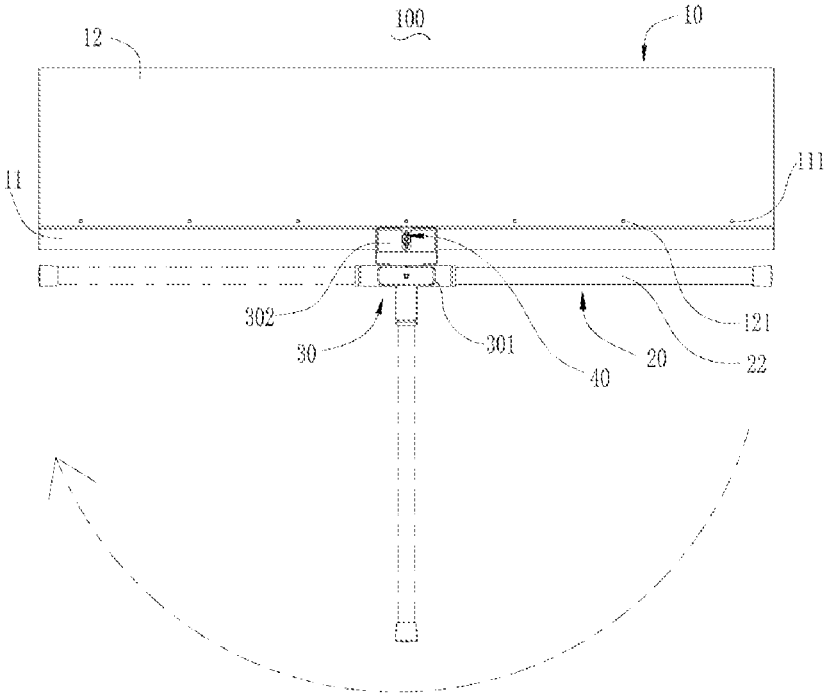
FIG. 1 is a schematic view of different state changes of a decorating tool in a first embodiment of the present disclosure.

100 represents a decorating tool; 10 represents a working portion; 11 represents a supporting portion; 111 represents an installation protrusion; 12 represents an operating portion; 121 represents an installation groove; 20 represents a grip portion; 21 represents a connector; 22 represents a grip member; 30 represents a connecting portion; 301 represents a first connecting member; 302 represents a second connecting member; 303 represents a first adjusting unit; 31 represents a first locking portion; 311 represents a first set of teeth; 312 represents a first through hole; 3121 represents a third set of teeth; 3122 represents a rotational gap; 313 represents a first contact surface; 314 represents a pressing groove; 32 represents a second locking portion; 321 represents a second set of teeth; 322 represents a second through hole; 323 represents a second contact surface; 3221 represents a fourth set of teeth; 331 represents a first connecting shaft; 3311 represents a first limiting portion; 3312 represents a first plug portion; 3313 represents a first pin hole; 332 represents a first adjusting member; 3321 represents a first protrusion; 3322 represents a second protrusion; 3323 represents a warping portion; 3324 represents a handle; 3325 represents a handle pin shaft; 3326 represents a second pin hole; 333 represents a first elastic member; 334 represents a gasket; 335 represents a second elastic member; 336 represents a locking member; 3361 represents a fifth set of teeth; 3362 represents a locking section; 3363 represents a smooth section; 337 represents a pressing member; 338 represents a third elastic member; 339 represents a locking-connecting member; 34 represents an accommodation groove; 40 represents a second adjusting unit; 41 represents a clamping member; 401 represents a snap plate; 402 represents a clamping channel; 411 represents a slot 412 represents a third through hole; 42 represents a second connecting shaft; 421 represents a second limiting portion; 422 represents a second plug portion; 43 represents a second adjusting member.

DETAILED DESCRIPTION

The technical solutions in the embodiments of the present disclosure are clearly and completely described in the following with reference to the accompanying drawings in the embodiments of the present disclosure. It is obvious that the described embodiments are only some of the embodiments, but not all of the embodiments. All other embodiments obtained by those skilled in the art based on the embodiments of the present disclosure without departing from the inventive scope are within the scope of the present disclosure.

All technical and scientific terms used herein have the same meaning as commonly understood by one of ordinary skill in the art to which this disclosure is claimed. The terminology used in the description herein is for the purpose of describing particular embodiments, and is not intended to limit the disclosure. The term "or/and" as used herein includes any and all combinations of one or more of the associated listed items.

Figure 2:
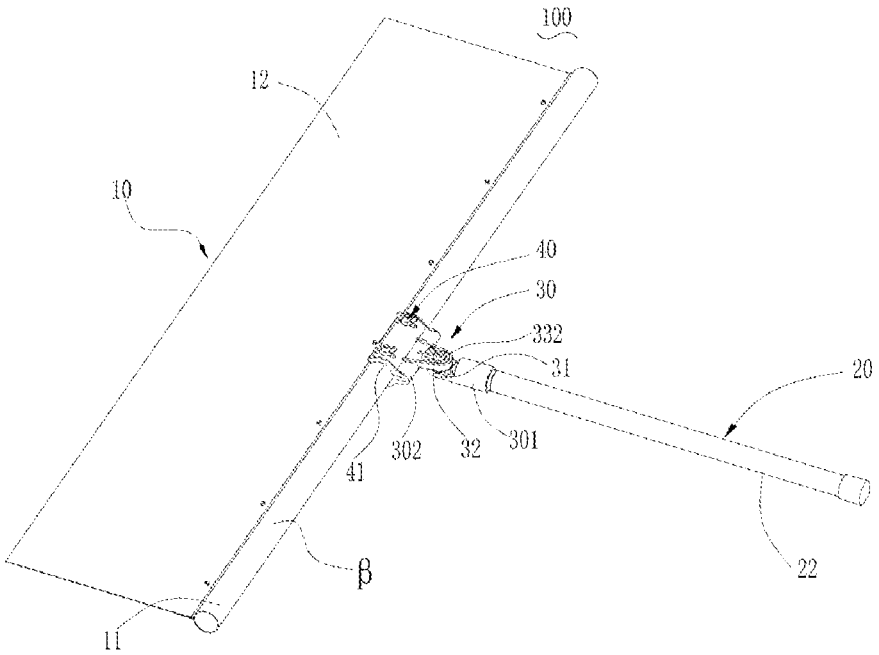
FIG. 2 is a structural schematic view of the decorating tool as shown in FIG. 1.
Figure 3:
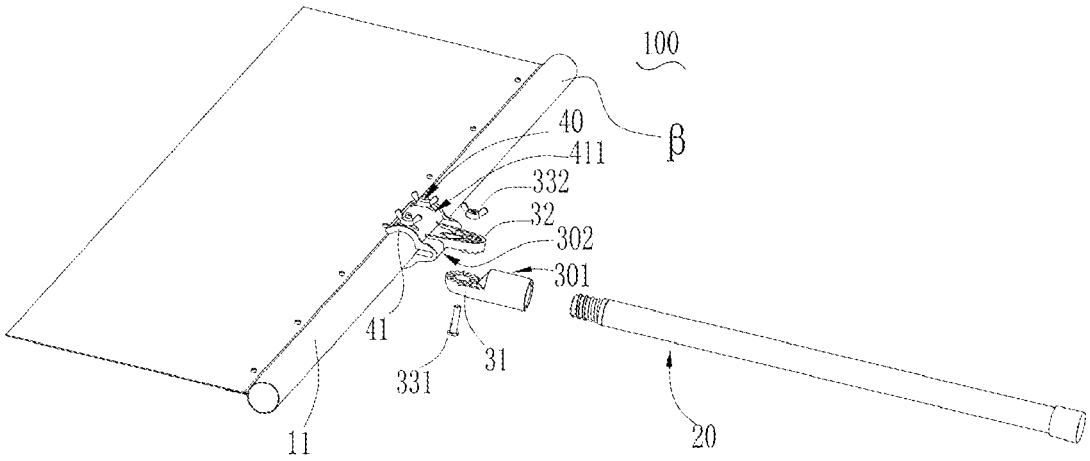
FIG. 3 is an exploded view of the decorating tool as shown in FIG. 2.
Figure 4:
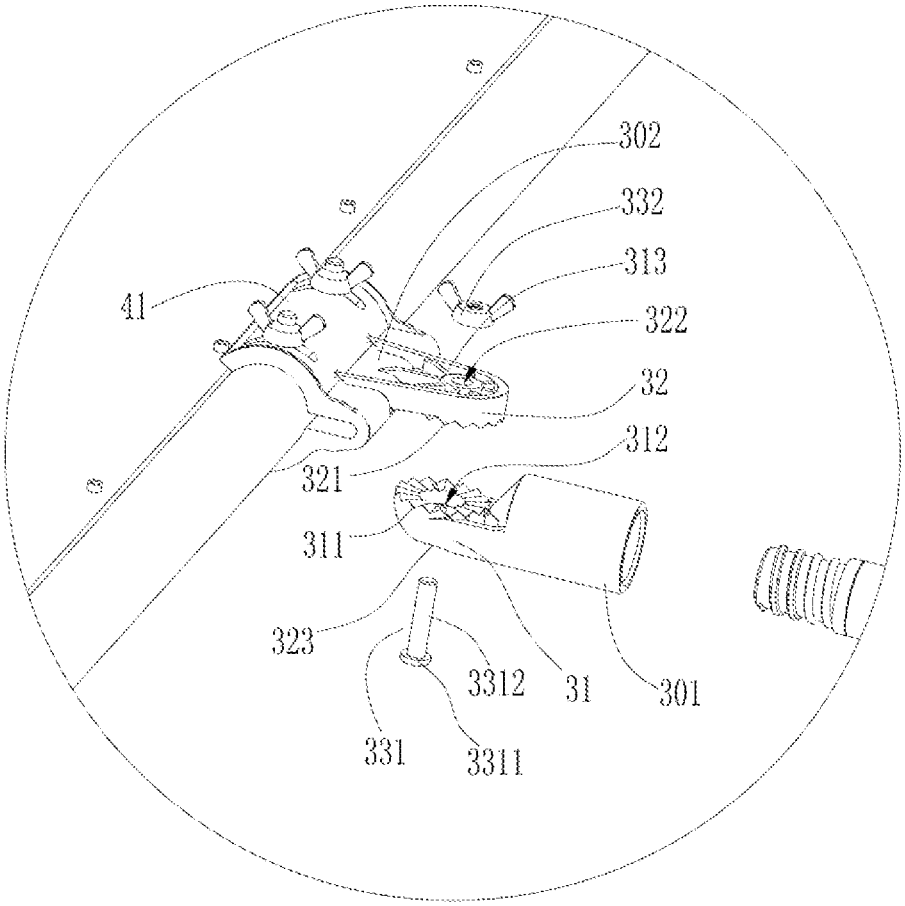
FIG. 4 is an exploded view of a partial of the decorating tool as shown in FIG. 2.

FIG. 1 is a schematic view of state changes of a decorating tool in first embodiment of the present disclosure, FIG. 2 is a structural schematic view of the decorating tool as shown in FIG. 1, FIG. 3 is an exploded view of the decorating tool as shown in FIG. 2, and FIG. 4 is an exploded view of a partial of the decorating tool as shown in FIG. 2.

The present disclosure provides a decorating tool 100 including a working portion 10 and a grip portion 20. The working portion 10 is configured for smoothing the surface of the objects or environments such as a building wall, a garden or a ground of a park, for example removing a painted layer on a surface of a wall, cleaning leaves and grass on the ground, etc. In other workplaces, the working portion 10 can be used as a shield for paint spraying. For example, when spraying paint on some objects or environment, the working portion 10 can be used to shield some objects or surfaces to prevent paint droplets from being sprayed on a surface of the objects or surfaces.

In a conventional art, a decorating tool is provided with a fixed connecting structure, and a relative position between the working portion and the grip portion is not adjustable. The conventional decorating tool is not conducive to be orderly stored when it is not used, and will occupy more space, so that a maximum transportation quantity of a single centralized transportation of the decorating tools is reduced. In addition, this structure cannot meet a requirement for adjusting the relative positions of the working portion and the grip portion in certain workplaces.

The decorating tool 100 in the present disclosure further includes a connecting portion 30. The working portion 10 and the grip portion 20 are connected to two ends of the connecting portion 30, respectively. The connecting portion 30 is configured for controlling the grip portion 20 to rotate towards or away from the working portion 10.

In the present disclosure, the decorating tool 100 is provided with a connecting portion 30, which is an adjustable structure between the working portion 10 and the grip portion 10. The grip portion 20 can be rotated to be adjacent to the working portion 10 to define an accommodation state of the decorating tool 100, which has a more regular shape and occupies a smaller space. When the decorating tool 100 is in the accommodation state, the decorating tool 100 can be orderly stored and occupy a smaller space, and interference between grip portions 20 of a plurality of the decorating tools 100 can be avoided, thereby increasing the number of the decorating tools 100 that can be stored within a certain volume for transport. The decorating tool 100 can also meet a requirement of adjusting the relative position between the grip portion 20 and the working portion 10 in some workplaces and enlarge a range of application of the decorating tool 100.

Referring to FIG. 1 to FIG. 4, a decorating tool 100 of a first embodiment of the present disclosure will be described in detail.

In the first embodiment, the working portion 10 can include a supporting portion 11 and an operating portion 12 fixed to the supporting portion 11. The supporting portion 11 can be configured for connecting the grip portion 20. The operating portion 12 can be configured for directly contacting the object or environment to be treated. The supporting portion 11 and the operating portion 12 can be independent from each other and fixed to each other. The supporting portion 11 can be in a tube shape, and a circumference wall of the supporting portion 11 protrudes along a direction perpendicular to an axial line of the tube to form a valgus plate. The valgus plate is provided with a plurality of installation protrusions 111 arranged uniformly.

The operating portion 12 can be a rectangular plate, which has a long side as long as that of the supporting portion 11. The long side of the operating portion 12 is attached to the valgus plate of the supporting portion 11. A plurality of installation grooves 121 are disposed at the operating portion 12 and matched with the installation protrusion 111. The operating portion 12 can be detachably fixed to the supporting portion 11 via the plurality of the installation protrusions 111 and the plurality of the installation grooves 121 matching with each other.

It should be understood that the operating portion 12 may be in other shapes, such as a triangle plate or a trapezoid plate, but is not limited as shown in the first embodiment.

In other embodiments, the operating portion can be fixed to the supporting portion with a plurality of rivets and rivet holes matching with each other, or a plurality of fasteners. In addition, the operating portion and the supporting portion can have an integrated structure.

Furthermore, in the first embodiment, the grip portion 20 can include a connector 21 and a grip member 22, which can be connected to each other. The grip member 22 can be in a hollow tube shape or in a rod shape. One end of the connector 21 can penetrate into an end of the grip member 22 near the working portion 10 and be fixed to the grip member 22. The other end of the connector 21 away from the grip member 22 can define an external thread section for connecting the connecting portion 30.

A first end of the connecting portion 30 can be fixed to an outer wall of the supporting portion 11, a second end of the connecting portion 30 can be threadedly connected to the connector 21. The grip portion 20 can rotate around the connecting portion 30 and move towards the working portion 10 in a plane parallel to an axial line of the supporting portion 11. A junction of the supporting portion 11 and the connecting portion 30 can divide the supporting portion 11 into two sections. The grip portion 20 can rotate adjacent to side of at least one section of the supporting portion 11. Moreover, one end of the grip portion 20 away from the connecting portion 20 will not protrude out from an end of the working portion 10, i.e., not out of the two end of the supporting portion 11.

Therefore, the grip portion 20 can be rotated to adjacent to the working portion 10, so that the decorating tool 100 can be adjusted to an accommodation state. In the accommodation state, the decorating tool 100 can be compact and uniform in structure, and facilitate storing when it is not being used.

Furthermore, the grip portion 20 can rotate relative to the supporting portion 11 in an angle range of 0 degree to 180 degrees. Referring to FIG. 1, the grip portion 20 can rotate relative to the connecting portion 30. The grip portion 20 can be rotated gradually from a position at which the grip portion 20 is parallel to the axial line of the supporting portion 11 to a position at which the grip portion 20 is perpendicular to the axial line of the supporting portion 11, and then to a position on the other side of the connecting portion 30 at which the grip portion 20 is also parallel to the axial line of the supporting portion 11. The first end of the connecting portion 30 can be connected to a middle part of the supporting portion 11. A length of a sidewall 13 of the working portion 10, i.e., the length of the supporting portion 11 can be twice a length of the grip portion 20. This can ensure that when the grip portion 20 is disposed adjacent to the sidewall of the supporting portion 11, the grip portion 20 will not protrude out from the two ends of the supporting portion 11.

Therefore, the grip portion 20 can be rotated to be perpendicular to the working portion 10, so that the decorating tool 100 can form a T-shape symmetric structure. Such decorating tool 100 can be more convenient to use, and more compact and regular in structure when it is not used, and facilitate orderly storing. Furthermore, the grip portion 20 can be adjusted to a position as required, where the grip portion 20 is neither perpendicular to the axial line of the supporting portion 11 nor parallel to the axial line of the supporting portion 11, so that the decorating tool 100 can be used in more workplaces.

Furthermore, in the first embodiment, the connecting portion 30 can have a locking state and an unlocking state. When the connecting portion 30 is in the unlocking state, the grip portion 20 can be rotated towards or away from the working portion 10, so as to change an entire shape of the decorating tool 100. When the connecting portion 30 is in the locking state, the grip portion 20 can be fixed to the working portion 10, so as to facilitate gripping the grip portion 20 and operating the working portion 10.

Specifically, the connecting portion 30 can include a first connecting member 301, a second connecting member 302, and a first adjusting unit 303. The first connecting member 301 can be threadedly connected to the connector 21, thereby further being fixed to the grip portion 20. The second connecting member 302 can be fixed to the working portion 10. The first connecting member 301 can correspond to the second end of the connecting portion 30, and threadedly connected to the connector 21. The second connecting member 302 can correspond to the first end of the connecting portion 30 fixed to the working portion 10. The first adjusting unit 303 can be configured for adjusting an angle defined by the first connecting member 301 and the second connecting member 302, so as to adjust the relative position and the angle between the grip portion 20 and the working portion 10.

The first end of the first connecting member 301 away from the grip portion 20 can protrude out and define a first locking portion 31. The first locking portion 31 can be provided with a first through hole 312 perpendicular to an axial line of the grip member 22, and a first set of teeth 311 can be defined on an edge of an opening of the first through hole 312. The first set of teeth 311 can include a plurality of tooth-shape convex ribs, which can be radially disposed around an axial line of the first through hole 312.

The second connecting member 302 can include a second locking portion 32. The second locking portion 32 can be provided with a second through hole 322 perpendicular to an axial line of the grip member 22, and a second set of teeth 321 can be defined on an edge of an opening of the second through hole 322. The second set of teeth 321 can include a plurality of tooth shaped convex ribs, which can be radially disposed around an axial line of the second through hole 322.

The first locking portion 31 can be disposed opposite to the second locking portion 32. When the axial line of the first through hole 312 coincides with the axial line of the second through hole 322, the first set of teeth 311 can be opposite to the second set of teeth 321. The first set of teeth 311 can match with and mesh with the second set of teeth 321. When the tooth shaped convex ribs of the first set of teeth 311 and the tooth shaped convex ribs of the second set of teeth 321 mesh with each other, the first locking portion 31 and the second locking portion 32 can be locked, so that the first connecting member 301 and the second connecting member 302 can be locked.

The first adjusting unit 303 can include a first connecting shaft 331 and a first adjusting member 332. The first connecting shaft 331 can include a first plug portion 3312 and a first limiting portion 3311 fixed to a first end of the first plug portion 3312. The first plug portion 3312 can penetrate through the first through hole 312 and the second through hole 322. An outer diameter of the first limiting portion 3311 can be larger than an outer diameter of the first plug portion 3312, and can be larger than the inner diameter of the first through hole 312 and the inner diameter of the second through hole 322. An axial length of the first plug portion 3312 is larger than a sum of an axial length of the first through hole 312 and an axial length of the second through hole 322.

A first contact surface 313 can be defined on a side of the first locking portion 31 away from the first set of teeth 311. A second contact surface 323 can be defined at the second side of the locking portion 32 away from the second set of teeth 321. The first limiting portion 3311 can abut against the first contact surface 323. A second end of the first plug portion 3312 away from the first limiting portion 3311 can protrude from the second locking portion and out of the second contact surface 323.

It should be understood that in other embodiments, the first limiting portion 3311 can abut against the second contact surface 323. The second end of the first plug portion 3312 can protrude from the first locking portion 31 and out of the first contact surface 313.

An outer wall of the second end of the first plug portion 3312 can be provided with an external thread. The first adjusting member 332 can sleeve on the second end of the first plug portion 3312, and be threadedly connected with the first plug portion 3312. The first adjusting member 332 can move along an axial line of the first plug portion 3312. When the first adjusting member 332 moves towards the first limiting portion 3311, the first limiting portion 3311 and the first adjusting member 332 can work together and make the first locking portion 31 meshed with the second locking portion 32 to define the locking state.

The first adjusting member 332 can move along a direction towards the first limiting portion 3311 until to a first adjustable position. When the first adjusting member 332 and the first limiting portion 3311 work on the first contact surface 313 and the second contact surface 323, respectively and make the first locking portion 31 meshed with the second locking portion 32, the first set of teeth 311 can mesh with the second set of teeth 321 and a position that the first adjusting member 332 located at can be regarded as the first adjustable position. When the first adjusting member 332 is screwed to the first adjustable position, the first connecting member 301 and the second connecting member 302 can form a locking state, so that the working portion 10 and the grip portion 20 can be locked by the connecting portion 30.

The first adjusting member 332 can further move along a direction away from the first limiting portion 3311 until to a second adjustable position. When a distance between the first adjusting member 332 and the first limiting portion 3311 is increased, a space for the first locking portion and the second locking portion 32 moving away from each other along an axial line of the first connecting shaft 331 can be formed. At the same time, the first set of teeth 311 and the second set of teeth 321 can separate from each other to make the first connecting member 301 rotate relative to the second connecting member 302, a position that the first adjusting member 332 located at can be regarded as the second adjustable position. When the first adjusting member 332 is located at the second adjustable position, the first locking portion 31 can be separated from the second locking portion 32, and the locking state between the first locking portion 31 and the second locking portion 32 is released therewith, so that the locking state between first connecting member 301 and the second connecting member 302 can be released, thereby the grip portion 20 can rotate relative to the working portion 10, i.e., the position of the grip portion 20 relative to the working portion 10 can be changed via the connecting portion 30.

It should be understood that in other embodiments, the first connecting shaft can be provided without the first limiting portion. At this time, two ends of the first connecting shaft can protrude from the first contact surface and the second contact surface, respectively, and be threadedly connected to two ends of the first connecting shaft via two first adjusting members. The first locking portion and the second locking portion can be changed between the locking state and the unlocking state by controlling the two first adjusting members to move towards or away from each other along an axial line of the first connecting shaft.

In the first embodiment, the first adjusting member 332 can be a butterfly nut. The adjusting member 332 can be screwed along the first connecting shaft 331 by directly acting on lugs of the butterfly nut 332 without any instrument. Therefore, the first adjusting unit 303 is more convenient to adjust manually.

It should be understood that the first locking portion and the second locking portion can not only be locked together by meshing, but also be locked together by static friction force to further lock the first connecting member and the second connecting member. When the first adjusting member is at the first adjustable position, the first adjusting member and the first limiting portion work together to increase a pressure and a static friction force between the first locking portion and the second locking portion. Therefore, the grip portion and the working portion can be locked. The method for locking the grip portion and the working portion can be not limited to the method in the first embodiment.

Figure 7:
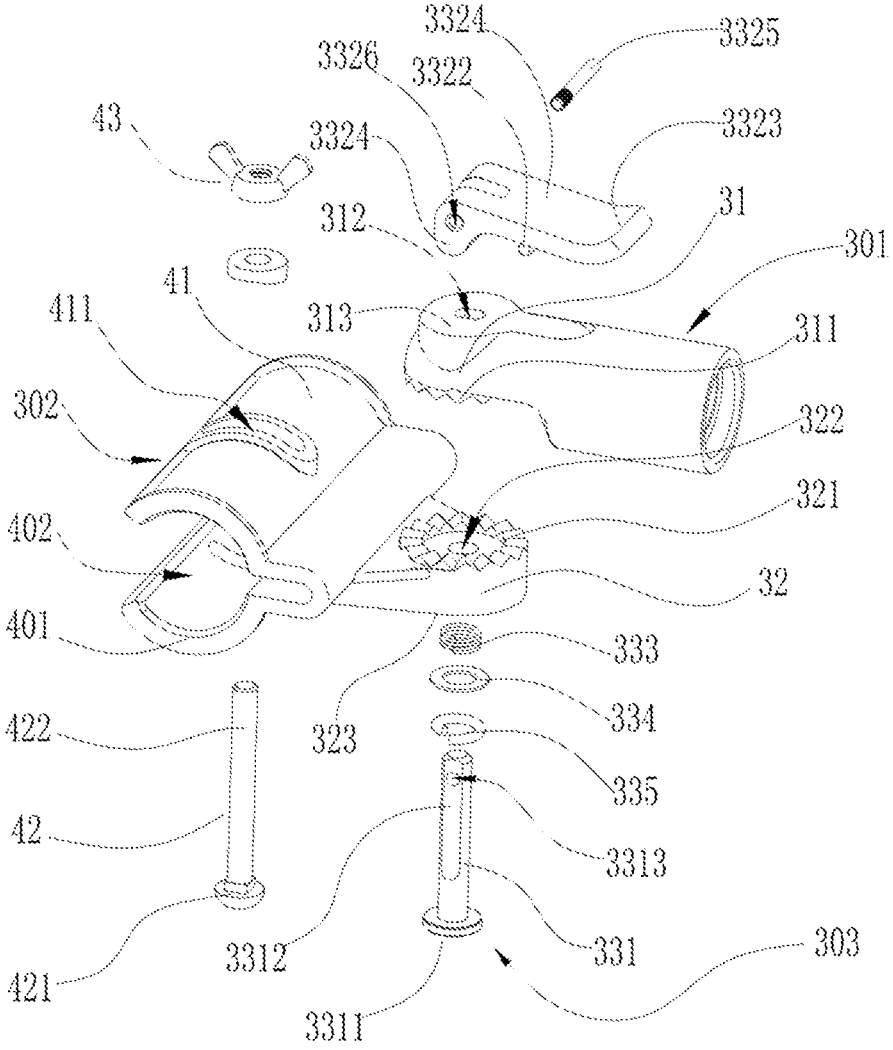
FIG. 7 is an exploded view of a partial of the decorating tool as shown in FIG. 5.

Referring to FIG. 7, the connecting portion 30 can further include a second adjusting unit 40. The connecting portion 30 can be connected to the supporting portion 11 via the second adjusting unit 40. The second adjusting unit 40 can be configured for adjusting a working angle of the decorating tool 100.

The working angle of the decorating tool 100 represents an angle defined by the grip portion and the operating portion when the grip portion is perpendicular to the supporting portion and the grip portion rotates in a plane perpendicular to the axial line of the supporting portion.

Specifically, the second adjusting unit 40 can include a clamping member 41, a second connecting shaft 42 and a second adjusting member 43. The clamping member 41 can be fixed to the second connecting member 302, sleeved on or surrounded around the outer wall of the supporting portion 11, and rotate in the plane perpendicular to the axial line of the supporting portion 11. The second connecting shaft 42 and the second adjusting member 43 can work together to fix the clamping member 41 and the supporting portion 11, so as to prevent the clamping member 41 from falling off and separating from the supporting portion 11.

The clamping member 41 can be located at a first end of the connecting member 302 away from the second locking portion 32, and integrated with the second locking portion 32. The clamping member 41 can include two snap plates 401. The two snap plates 41 can be symmetric, and define a clamping channel 402 being configured for surrounding or sleeving on the supporting portion 11. The clamping channel 402 can be a through hole or a groove extending along a direction perpendicular to the second through hole 322. It should be understood that the clamping member may be separated from the second locking portion and fixed to the second locking portion in other embodiments.

The two snap plates 401 can define a cylindrical surface matching with the outer wall of the supporting portion 11. When the clamping member 41 surrounds or sleeves on the supporting portion 11, the second connecting member 302 can rotate around the axial line of the supporting portion 11, and drive the grip porting 20 connecting to the connecting portion 30 to rotate around the axial line of the supporting portion 11.

Therefore, the applicability of the decorating tool 100 can be further improved. The working angle of the decorating tool can be adjusted by the user to meet requirements of some special workplaces. For example, the decorating tool can be used as a shovel.

Furthermore, the clamping member 41 can be provided with a waist shaped hole 411 along a circumference of the supporting portion 11. The supporting portion 11 can be provided with a third through hole 412 having an inner diameter matching with a width of the waist shaped hole 411. The second connecting shaft 42 can include the third through hole 412 and a second plug portion 422 penetrated through the third through hole 412 and the waist shaped hole 411. When the clamping member 41 rotates around the axial line of the supporting portion 11, the third through hole 412 can move relative to the waist shaped hole 411 along the extending direction of the waist shaped hole 411, and drive the second connecting shaft 42 to move relative to the supporting portion 11 inside the waist shaped hole 411.

The second connecting shaft 42 can further include a second limiting portion 421 fixed to a first end of the second plug portion 422. An outer diameter of the second limiting portion 421 can be larger than the inner diameter of the third through hole 412 and the width of the waist shaped hole 411. The second limiting portion 421 can abut against an outer wall of one of the two snap plates 401. A second end of the second plug portion 422 away from the second limiting portion 421 can protrude out from the outer wall of another snap plate 401. The second end of the second plug portion 422 can be provided with an external thread. The second adjusting member 43 can sleeve on the second end of the second plug portion 422 and can be threadedly connected to the second portion 422. That is, the second limiting portion 421 and the second adjusting member 43 can be disposed on two opposite outer surfaces of the two snap plates 401, respectively.

The second adjusting member 43 can move towards the second limiting portion 421, and work together with the second limiting portion 421 to tightly press the supporting portion 11 in the clamping channel 402 between the two snap plates 401, so that the inner wall of the two snap plates 401 can be tightly attached to the outer wall of the supporting portion 11. The second adjusting member 43 can further move towards a direction away from the second limiting portion 421 to define a space for the two snap plates 401 to move away from each other by an elastic deformation, so as to release a pressure on the supporting portion 11 from the clamping member 41. At this time, the clamping member 41 can move in the plane perpendicular to the supporting portion 11 to change a position of the second connecting shaft 42 inside the waist shaped hole 411, thereby adjusting the working angle defined by the grip portion 20 and the operating portion 12.

When the pressure on the supporting portion 11 from the clamping member 41 is released, the supporting portion 11 can be rotated relative to the clamping member 41. The second adjusting member 43 can move towards the second limiting portion 421 along the second connecting shaft 42, and tightly press the supporting portion 11 between the two snap plates 401, so that the position of the second connecting shaft 42 in the waist shaped hole 411 can be changed.

The second adjusting unit 40 has a locking state and an unlocking state. When the second adjusting unit 40 is in the locking state, the clamping member 41 and the supporting portion 11 can be tightly pressed together. When the second adjusting unit 40 is in the unlocking state, the clamping member 41 and the supporting portion 11 can be unlocked. The working angle of the decorating tool 100 can be conveniently and quickly changed by locking or unlocking the second adjusting unit 40 and the working portion 10. It should be understood that when the second adjusting member 43 moves away from the second limiting portion 421, the supporting portion 11 can move between the two snap plates 401 along the extending direction of the clamping channel 402. It should be further understood that the third through hole 412 can be located on the two snap plates 401 of the clamping member 41, and the waist shaped hole 411 can be located on the circumference wall of the supporting portion 11 and extend along the circumference of the supporting portion 11. When the clamping member 41 rotates around the axial line of the supporting portion 11, the third through hole 412 can further move along the extending direction of the waist shaped hole relative to the waist shaped hole 411. When the second connecting shaft 42 penetrates through the third through hole 412 and the waist shaped hole 411, the position of the second connecting shaft 42 in the waist shaped hole 411 can be changed be by adjusting the clamping member 41 in a plane perpendicular to the axial line of the supporting portion 11. A structure of the decorating tool is not limited as shown in the first embodiment.

In other embodiment, the second connecting shaft can be provided without the second limiting portion. Two ends of the connecting shaft can protrude from the outer wall of the two snap plates, respectively. At the same time, the decorating tool can be provided with two second adjusting members sleeved on an end of the second connecting shaft and matching with a thread of the second connecting shaft. The first locking portion and the second locking portion can be adjusted to load or unload pressure on the clamping member by driving the two adjusting members to move towards or away from each other on the second connecting shaft.

Furthermore, the second adjusting member 43 can be a butterfly nut sleeved on the second connecting shaft 42 and matching with the thread of the second connecting shaft 42. It should be understood that the second adjusting member 43 can be a movable clip, a hasp or other adjusting elements having a locking function.

Furthermore, the supporting portion 11 can be provided with a plurality of third through holes 412, which can be arranged along the axial line of the supporting portion 11. Or, the supporting portion 11 can be provided with a plurality of waist shaped holes, which can be arranged along the axial line of the supporting portion 11.

Therefore, the second connecting shaft 42 can penetrate through different third through holes 412 or waist shaped holes 411, respectively, so that the clamping member 41 can sleeve or surround the supporting portion 11 along the axial line of the supporting portion 11. An installation position of the clamping member 41 on the supporting portion 11 can be adjusted, and an installation position of the grip portion 20 on side wall of the working portion 10 can be adjusted, so as to further improve the applicability of the decorating tool 100 to meet requirements of different workplaces.

The decorating tool 100 in the first embodiment has a simple structure, and is convenient to use. The butterfly nut can be manually screwed or unscrewed to move on the first connecting shaft 331 to change a distance between the butterfly nut and the first limiting portion 3311, so as to load or unload pressure on the first locking portion 31 and the second locking portion 32 with the first adjusting unit 303, thereby switching the connecting portion 30 between the locking state and the unlocking state. The angle defined by the grip portion 20 and the working portion 10 and the relative position between the grip portion 20 and the working portion 10 can be changed by screwing or unscrewing the butterfly nut.

Figure 5:
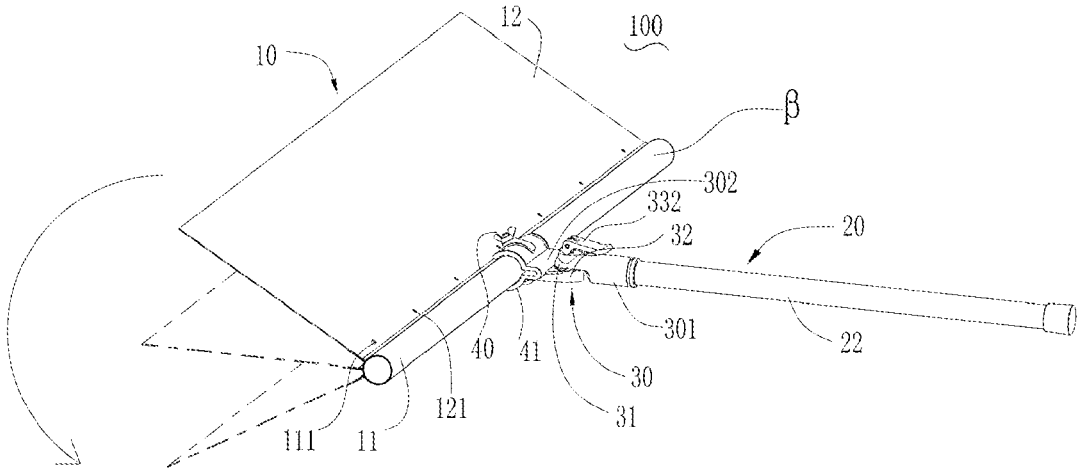
FIG. 5 is a structural schematic view of the decorating tool in a second embodiment of the present disclosure.
Figure 6:
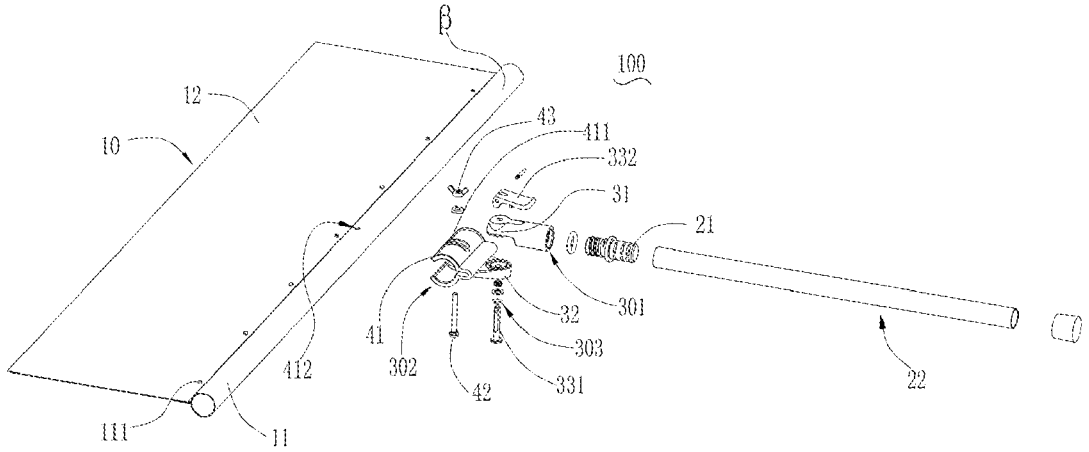
FIG. 6 is an exploded view of the decorating tool as shown in FIG. 5.
Figure 8:
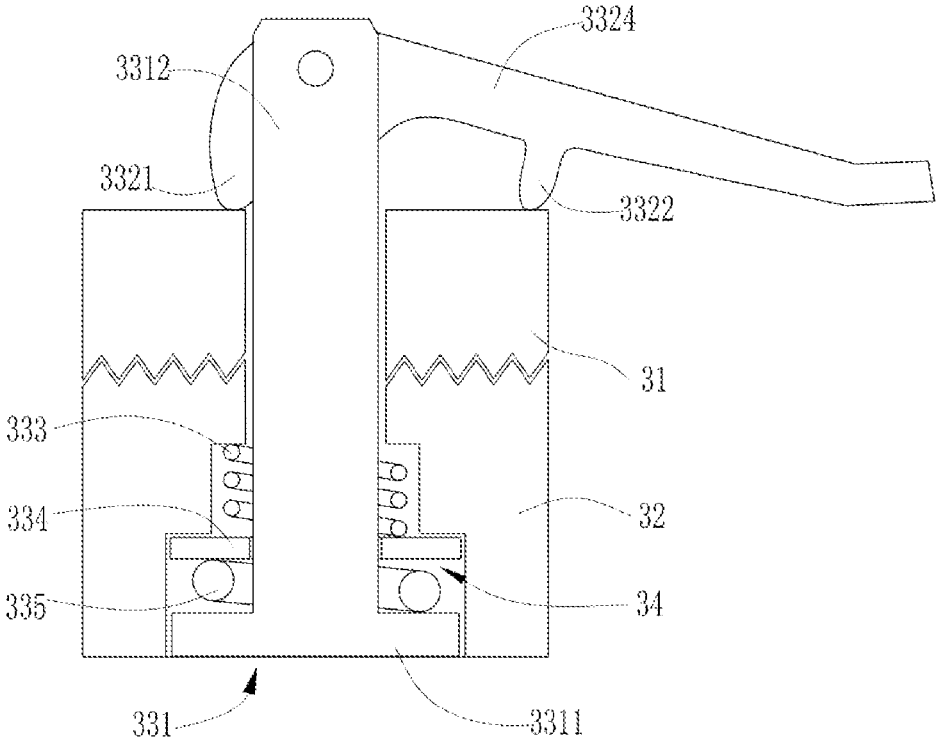
FIG. 8 is a section view of a first adjusting unit of the decorating tool as shown in FIG. 5, and the first adjusting unit is at a first adjustable position.
Figure 9:
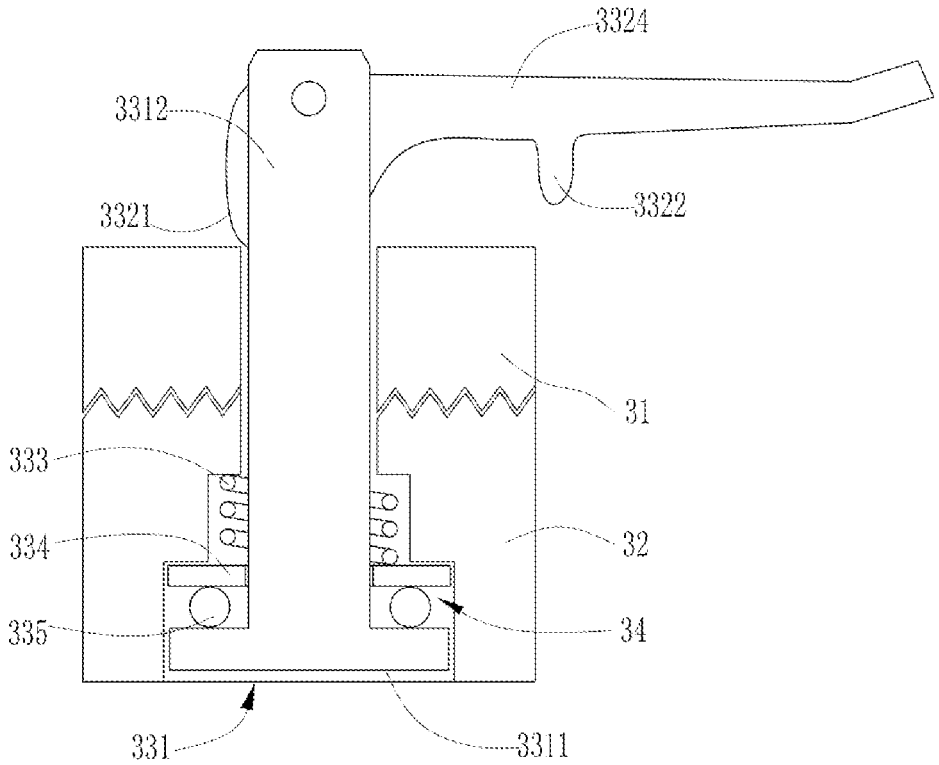
FIG. 9 is a section view of the first adjusting unit of the decorating tool as shown in FIG. 5, and an elastic member is at a compressed extreme position.
Figure 10:
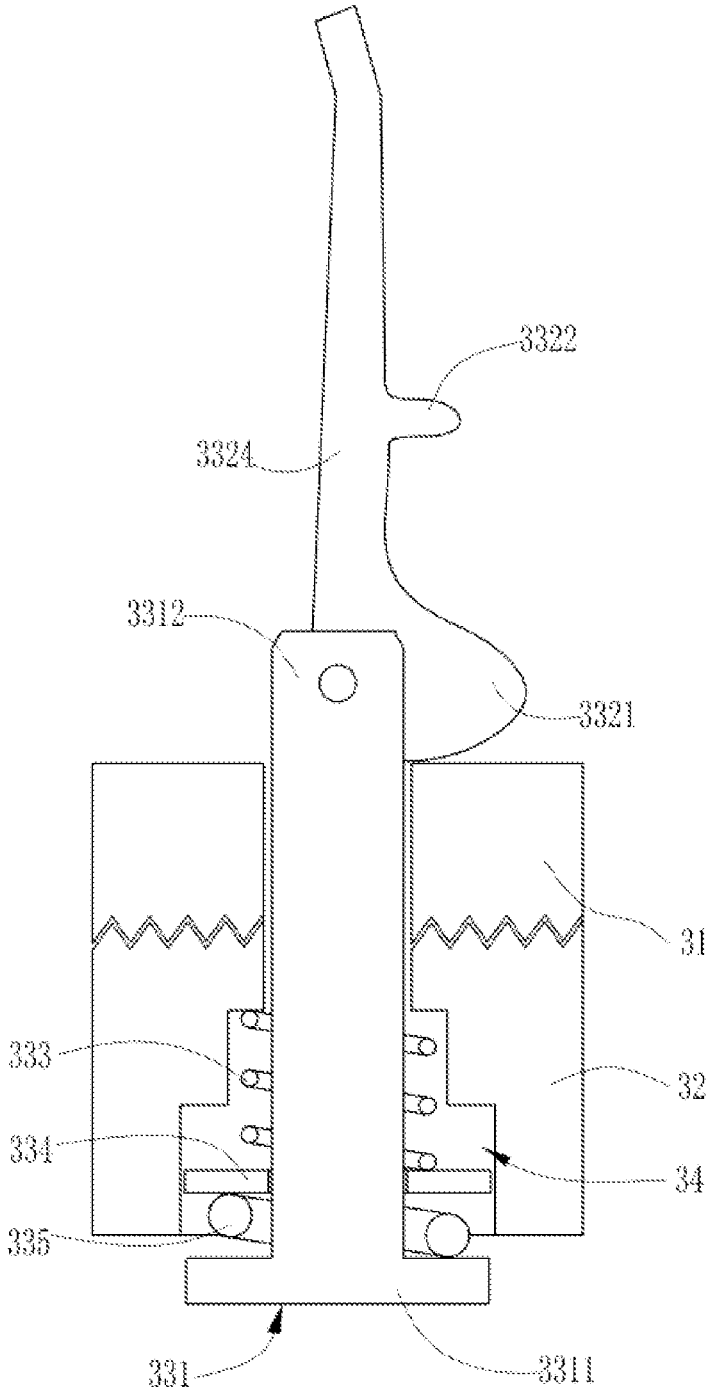
FIG. 10 is a section view of the first adjusting unit of the decorating tool as shown in FIG. 5, and the first adjusting unit is at a second adjustable position.

The decorating tool 100 provided in a second embodiment of the present disclosure will be described hereinafter. A structure of the decorating tool 100 in the second embodiment is substantially the same as that of the decorating tool 100 in the first embodiment, the differences are that the first adjusting member 323 in the second embodiment can have a different structure. FIG. 5 is a structural schematic view of the decorating tool of the second embodiment of the present disclosure, FIG. 6 is an exploded view of the decorating tool as shown in FIG. 5, FIG. 7 is an exploded view of a partial of the decorating tool as shown in FIG. 5, FIG. 8 is a section view of a first adjusting unit of the decorating tool as shown in FIG. 5, and the first adjusting unit is at a first adjustable position, FIG. 9 is a section view of the first adjusting unit of the decorating tool as shown in FIG. 5, and an elastic member is at a compressed extreme position, and FIG. 10 is a section view of the first adjusting unit of the decorating tool as shown in FIG. 5, and the first adjusting unit is at a second adjustable position.

In the second embodiment, a first adjusting member 332 can be a wrench handle. The first adjusting member 332 can be rotationally connected to the first connecting shaft 331. The locking state and the unlocking state of the connecting portion 30 can be switched by rotating the first adjusting member 332 and changing an angle defined by the first adjusting member 332 and the first connecting shaft 331.

Similarly to the first embodiment, the first connecting shaft 331 in the second embodiment can include a first plug portion 3312 and a first limiting portion 3311 fixed to a first end of the first plug portion 3312. An outer diameter of the first limiting portion 3311 can be larger than an outer diameter of the first through hole 312 and the inner diameter of the second through hole 322. An axial length of the first plug portion 3312 can be larger than a sum of an axial length of the first through hole 312 and an axial length of the second through hole 322. The first plug portion 3312 can penetrate through the second through hole 322 and the first through hole 312 from the second contact surface 323, and protrude out from the first contact surface 313. Moreover, the first limiting portion 3311 can abut against the second contact surface 323.

A second end of the first plug portion 3312 protruding out from the first contact surface 313 can be provided with a first pin hole 3313 penetrating through the first plug portion 3312. An axial line of the pin hole 3313 can be perpendicular to an axial line of the first plug portion 3312. The first adjusting member 332 can include a handle 3324 and the first protrusion 3321 fixed to the side wall of the handle 3324, and the first protrusion 3321 can be provided with a second pin hole 3326.

The first adjusting unit 303 can further include a first pin hole 3313 and a handle pin shaft 3325 of the second pin hole 3326. The first adjusting member 332 can be pivotally connected to the first plug portion 3312 via the handle pin shaft 3324.

The first protrusion 3321 can be located on one side of the handle 3324. The first protrusion 3321 can be in a wheel shape and protrude from the first contact surface 313. When the first adjusting member 332 rotates relative to the first connecting shaft 331, the first protrusion 3321 can abut against the first contact surface 313 and push the first locking portion 31 to move towards the second locking portion 32. That is, the first protrusion 3321 and the first limiting portion 3311 can work together and load pressure on the first locking portion 31 and the second locking portion 32, and make the first set of teeth 311 meshed with the second set of teeth 321, so as to lock the first locking portion 31 and the second locking portion 32.

In addition, when the first adjusting member 332 rotates relative to the first connecting shaft 331, the first protrusion 3321 can leave away from the first contact surface 313, so that a distance between the first protrusion 3321 and the first limiting portion 3311 can be increased, leaving enough space for the first locking portion 31 and the second locking portion 32 moving away from each other along an axial line of the first connecting shaft 331, thereby releasing the meshing state between the first set of teeth 311 and the second set of teeth 321.

Specifically, the number of the first protrusion 3321 can be two. The two first protrusions 3321 can define a gap, the first plug portion 3312 can pass through the gap. It should be understood that the number of the first protrusion 3321 can be one, as long as the first protrusion 3321 can abut against and push the first contact surface 313.

Furthermore, the first adjusting member 332 can further include a second protrusion 3322 and a warping portion 3323. The second protrusion 3322 and the first protrusion 3321 can be located at a same side of the handle 3324. Both the second protrusion 3322 and the first protrusion 3321 can abut against and push the first contact surface 313. The warping portion 3323 can be located at an end of the handle 3324 away from the first protrusion 3321, and the warping portion 3323 can bend along a direction opposite to the first protrusion 3321 and the second protrusion 3322, so that the first adjusting member 332 can be conveniently grabbed and pulled.

Furthermore, the first adjusting unit 303 can further include a first elastic member 333, a gasket 334 and a second elastic member 335. The second elastic member 333 and the first elastic member 335 can have different elastic coefficients, and they can deform in different degrees under the same external force.

Furthermore, the first elastic member 333 can be a telescopic spring having a relative small elastic coefficient, and the second elastic member 335 can be an elastic gasket having a relative large elastic coefficient. The first elastic member 333, the gasket 334 and the second elastic member 335 can be successively sleeved on the first plug portion 3312 and the first connecting shaft 331. Two sides of the gasket 334 can abut against the first elastic member 333 and the second elastic member 335, respectively. This can prevent the first elastic member 333 and the second elastic member 335 from interfering or sleeving with each other under pressure, and define a reliable series along the first connecting shaft 331.

The first elastic member 333 and the second elastic member 335 have different coefficients represents that the first elastic member 333 and the second elastic member 335 can be made of materials having different elasticity modulus, or the first elastic member 333 and the second elastic member 335 made of the same materials can have different cross section areas, or the first elastic member 333 and the second elastic member 335 can have different cross section areas and made of different materials.

The second locking portion 32 can further be provided with a second through hole 322 and an accommodation groove 34 communicating with the second groove 322. The accommodation groove 34 can be configured for accommodating the first elastic member 333, the gasket 334 and the second elastic member 335. A second end of the first elastic member 333 away from the second elastic member 335 can abut against the bottom of the accommodation groove 34. An end of the second elastic member 335 away from the first elastic member 333 can abut against the first limiting portion 3311. It should be understood that the accommodation groove 34 can be disposed on the first locking portion 31 and communicate with the first through hole 312. At the same time, the first limiting portion 3311 can abut against the first contact surface 313, and the first protrusion 3321 can abut against the second contact surface 323.

The first protrusion 3321 and the first limiting portion 3311 can jointly abut against and press the first locking portion 31 and abut against the second locking portion 32, respectively. The elastic member 333 and the second elastic member 335 can be compressed in the accommodation groove 34, and elastically push the first connecting shaft 331.

When the first adjusting member 332 is rotated to make the first protrusion 3321 and the second protrusion 3322 leave away from the first contact surface 313, an enough space can be formed between the first protrusion 3321 and the first limiting portion 3311, resulting in the first locking portion 31 and the second locking portion 32 moving away from each other along the axial line of the first connecting shaft 331, so as to facilitate the first adjusting unit 303 to release elastic shrinkage potential energy of the first elastic member 333 and the second elastic member 335. The first connecting shaft 331 can be pushed to move away from the first adjusting member 332 by the first elastic member 333 and the second elastic member 335. That is, the first elastic member 333 and the second elastic member 335 can have a tendency to push the first connecting shaft 331 away from the first through hole 312 and the second through hole 322 in a direction away from the first adjusting member 332.

It should be understood that in other embodiments, the first adjusting unit can independently include only one of the first elastic member 333 and the second elastic member 335. Two ends of the elastic member can be connected to the bottom of the accommodation groove 34 and the first limiting portion 3311, respectively, as long as the elastic member can elastically push the first connecting shaft 331 through the first through hole 312 and the second through hole 322 along the direction away from the first adjusting member 332.

The first adjusting unit 303 can have at least three positions: a first adjustable position, a second adjustable position, and a compression position. The compression position is that the elastic member is extremely compressed. Referring to FIG. 8 to FIG. 10, the first adjusting member 332 can rotate relative to the first connecting shaft 331 in a plane parallel to the axial line of the first connecting shaft 331 and move to the first adjustable position, so that the connecting portion 30 can be in the locking state. The first adjusting member 332 can also be rotated to a compression position, so that the first adjustment unit 303 can apply an instantaneously maximum pressing force on the first rotation stop portion 31 and the second rotation stop portion 32. And the first adjusting member 332 can be rotated to the second adjustable position, so that the connecting portion 30 reaches the unlocked state.

When the first adjusting unit 303 is at the first adjustable position, the first protrusion portion 3321 and the second protrusion portion 3322 can abut against the first contact surface 313 at the same time, and the first limiting portion 3311 can abut against the second contact surface 323, the first limiting portion 31 and the second limiting portion 32 can be pressed against each other under the joint action of the first adjusting member 332 and the first limiting portion 3311, and the first set of teeth 311 and the second set of teeth 321 can mesh with each other, and position between the first adjusting member 332 the first connecting shaft 331 can be fixed. At this time, the first connecting member 301 can be fixed to the second connecting member 302, the first elastic member 333 can be in an extreme compression state, and the second elastic member 335 can be in a free state or a partially compression state. The first elastic member 333 and the second elastic member 335 jointly exert an elastic pushing force on the first limiting 3311 and can have a tendency to push the first connecting shaft 331 to move away from the first adjusting member 332. Under this tendency, both the first protrusion portion 3321 and the second protrusion portion 3322 can apply a pressing force on the first contact surface 313, so that the first adjusting member 332 can reach a stable contact with the first limiting portion 31. The first protrusion portion 3321 and the second protrusion portion 3322 jointly can abut against the first contact surface 313, which can improve the stability of the pressing contact of the first adjusting member 332 on the first locking portion 31 and the second locking portion 32, prevent the first adjusting member 332 from rotating due to accidental disturbance, and prevent the first adjusting member 332 from sliding relative to the first contact surface 313, thereby avoiding the release of the compression state between the first locking portion 31 and the second locking portion 32.

When the first adjusting unit 303 is at the compression position, the first adjusting member 332 can be rotated to a preset angle, the handle portion 3324 can drive the second protrusion portion 3322 away from the first contact surface 313. At the same time, the first protrusion portion 3321 can be driven to rotate, so that the distance between the contact point on the first contact surface 313 that contacts the first protrusion portion 3321 and the first pin hole 3313 in the axial line of the first connecting shaft 331 can be slightly increased, and the first protrusion portion 3321 can still abut against the first contact surface 313 and press the first contact surface 313. At the same time, the first adjusting member 332 can drive the first connecting shaft 331 to move in a direction close to the first adjusting member 332, and the second elastic member 335 can be further compressed.

When the first adjusting member 332 is at this position, the comprehensive compression deformation amount of the first elastic member 333 and the second elastic member 335 can reach the maximum value, and the compression deformation amount of both the first elastic member 333 and the second elastic member 335 can reach their limit values, respectively, and the elastic thrust of the two acting on the first limiting portion 3311 can reach a peak value. The first adjusting unit 303 can reach a critical equilibrium state, and apply a maximum instantaneously pressing force to the first locking portion 31 and the second locking portion 32. In addition, the pressing force of the first adjustment member 332 on the first locking portion 31 and the second locking portion 32 can be greater than the pressing force when the first adjusting member 332 is in the first adjustable position.

On one hand, when the first adjusting member 332 is pulled to the compression position, the user must overcome the instantaneously maximum pressing force to enable the first adjustment unit 303 to overleap the compression extreme position of the elastic member, so as to drive the first protrusion 3321 and the second protrusion 3322 to leave away from the first contact surface 313, thereby releasing the locking state of the first locking portion 31 and the second locking portion 32. On the other hand, the user must overcome the instantaneously maximum pressing force to enable the first adjustment unit 303 to overleap the compression extreme position of the elastic member, and drive the first protrusion 3321 and the second protrusion 3322 to abut against the first contact surface 313, so that the first adjusting member 332 and the first limiting portion 3311 can work together to load pressing force to the first locking portion 31 and the second locking portion 32, thereby releasing the locking of the first locking portion 31 and the second locking portion 32.

When the first adjusting unit 303 is at the second adjustable position, the first adjusting member 332 can continue to rotate from the compression position, both the first protrusion 3321 and the second protrusion 3322 can leave away from the first contact surface 313, and an enough space between the first adjusting member 332 and the first limiting portion 3311 can be generated and configured for the first locking portion 31 and the second locking portion 32 moving away from each other along the axial line of the first connecting shaft 331. When the first adjusting unit 303 is at the compression position, the elastic shrinkage potential energy of the first elastic member 333 and the second elastic member 335 can be quickly released, pushing the first connecting shaft 331 in the direction away from the first adjusting member 332. At this time, an enough space between the first set of teeth 311 and the second set of teeth 321 can be generated, so that the first set of teeth 311 and the second set of teeth 321 will move away from each other and the meshing of the first set of teeth 311 and the second set of teeth 321 will be released. When the first adjusting unit 303 is at the second adjustable position, the locking state of the first connecting member 301 and the second connecting member 302 can be released, so that the connecting portion 30 can be changed to the unlocking state. At this time, the grip portion 20 can be rotated to adjust the angle of the grip portion 20 and the supporting portion 11 and the relative position thereof.

When the first adjusting unit 303 is at the first adjustable position and the compression position, the first limiting portion 3311 can be accommodated in the accommodation groove 34, and not higher than the edge of the accommodation groove 34. Therefore, deviation or loosening of the first connecting shaft 331 in the first through hole 312 and the second through hole 322 caused by accidental collision from external objects on the first connecting shaft 331 can be avoided. In addition, the first elastic member 333 and the second elastic member 335 accommodated in the accommodation groove 34 can be better protected.

In other embodiments, the first adjusting unit can be provided without a first elastic member and a second elastic member. A first locking portion and a second locking portion can be pressed and locked by jointly loading pressure on the first locking portion and the second locking portion with a first adjusting member and a first limiting portion.

The decorating tool 100 in the second embodiment can be convenient and quickly adjusted. The handle can be pulled to rotate in the plane parallel to the axial line of the first connecting shaft 331, and change the distance between the first protrusion 3321 and the first limiting portion 3311 and between the second protrusion 3322 and the first limiting portion 3311, so that the first adjusting unit 303 can load or unload pressure on the first locking portion 31 and the second locking protrusion 32. The first elastic member 333 and the second elastic member 335 can have a tendency to push the first connecting shaft 331 to move along a direction away from the first adjusting member 332, and facilitate the first adjusting unit 303 to ensure the first locking portion 31 and the second locking portion 32 to be stably and reliably locked.

Figure 11:
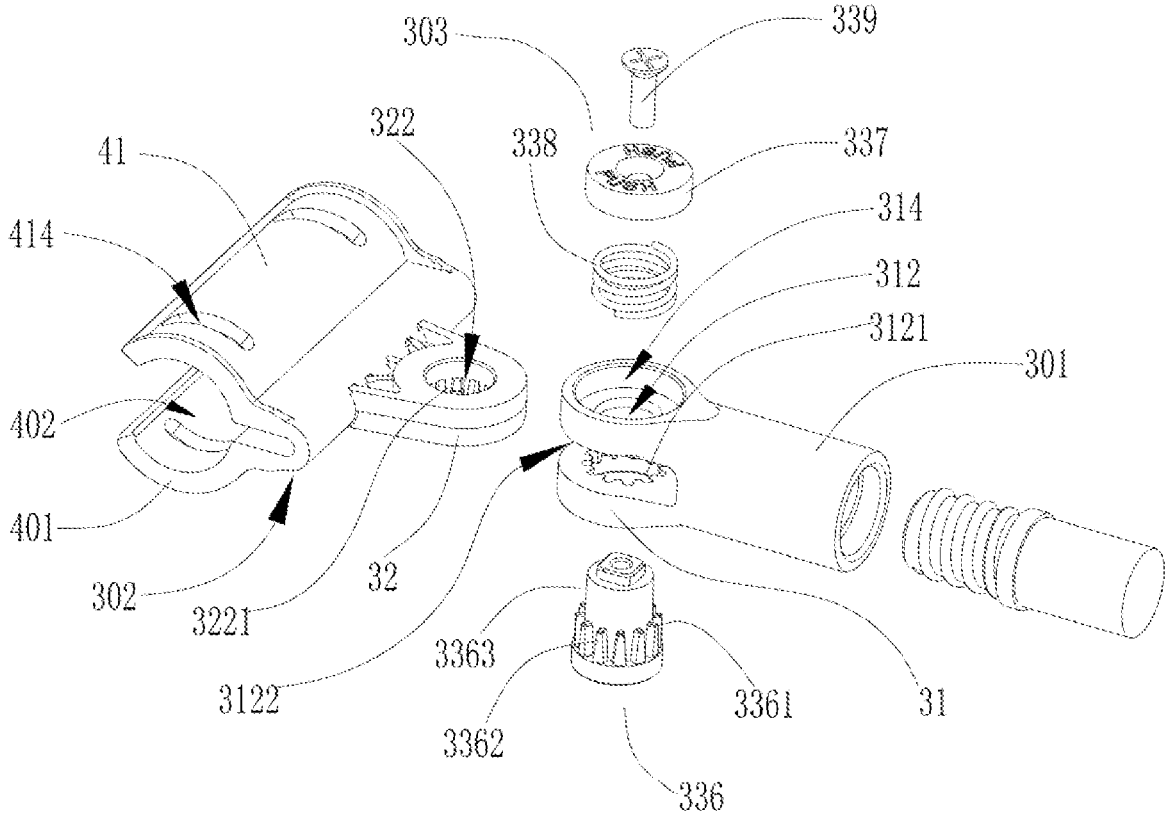
FIG. 11 is an exploded view of a part of the decorating tool in a third embodiment of the present disclosure.

FIG. 11 is an exploded view of a partial of the decorating tool as shown in a third embodiment of the present disclosure. The decorating tool 100 in the third embodiment of the present disclosure will be described in details hereinafter. Compared with the first embodiment, a structure of a first adjusting unit 303 in the third embodiment is different, and a first locking portion 31 and a second locking portion are locked and unlocked in a different way.

In the third embodiment, the number of the first locking portions 31 can be two. A rotational gap 3122 for accommodating the second locking portion 32 can be defined between the two first locking portions 31. Each of the two first locking portions 31 can be provided with a first through hole 312. An inner wall of each of the two first through holes 312 can be provided with a third set of teeth 3121, i.e., the number of the third sets of teeth 3121 can be two. Each third set of teeth 3121 can be defined by a plurality of tooth shaped convex ribs extending along an axial line of the first through hole 312, and the plurality of tooth shaped convex ribs can be arranged around an axial line of the first through hole 312. The second locking portion 32 can be provided with a second through hole 322. An inner wall of the second through hole 322 can be provided with a fourth set of teeth 3221. The fourth set of teeth 3321 can be defined by a plurality of tooth shaped convex ribs extending along an axial line of the second through hole 322, and the plurality of tooth shaped convex ribs can be arranged around an axial line of the second through hole 322.

A number of the tooth shaped convex ribs of the third set of teeth 3121 can be equal to a number of the tooth shaped convex ribs of the fourth set of teeth 3221. When the second locking portion 32 is located in the rotational gap 3122 between the two first locking portions 31 and the axial line of the first through hole 312 coincides with the axial line of the second through hole 322, the fourth set of teeth 3221 can be located between two third sets of teeth 3121.

Furthermore, in the third embodiment, the first adjusting unit 303 can include a locking member 336 penetrated through the first through hole 312 and the second through hole 322. The locking member 336 can have a roller shaped structure, and include a locking section 3362 and a smooth section 3363 connected to each other. The locking member 336 can move along the axial line of the first through hole 312 in the first through hole 312 and the second through hole 322. Therein, an outer diameter of the locking section 3362 can match with an inner diameter of the first through hole 312 and an inner diameter of the second through hole 322. An outer wall of the locking section 3362 can be provided with a fifth set of teeth 3361, the fifth set of teeth 3361 can be defined by a plurality of tooth shaped convex ribs extending along an axial line of the locking member 336, and the plurality of tooth shaped convex ribs can be arranged around an axial line of the locking member 336.

Specifically, a number of the tooth shaped convex ribs in the fifth set of teeth 3361, the number of the tooth shaped convex ribs in the third set of teeth 3121 and the number of the tooth shaped convex ribs in the fourth set of teeth 3221 are the same. A shape of any one of the tooth shaped convex ribs of the fifth set of teeth 3361 can match with a groove between any two tooth shaped convex ribs of the third set of teeth 3121 or a groove between any two tooth shaped convex ribs of the fourth set of teeth 3221. That is, any one of the tooth shaped convex ribs of the fifth set of teeth 3361 can match with a groove between any two tooth shaped convex ribs of the third set of teeth 3121, and further match with a groove between any two tooth shaped convex ribs of the fourth set of teeth 3221. The fifth set of teeth 3361 cam mesh with the third set of teeth 3121 and the fourth set of teeth 3221.

An outer wall of the smooth section 3363 can be provided without the fifth set of teeth 3361. Furthermore, an outer diameter of the smooth section 3363 can be smaller than a minimum outer diameter of the locking section 3362. Only when the smooth section 3363 penetrates through the first through hole 312 or the second through hole 322 and the locking section 3362 is not penetrated through the first through hole 312 and the second through hole 322, the fifth set of teeth 3361 cannot be meshed with the third set of teeth 3121 or the fourth set of teeth 3221. At this time, the locking member 336 can rotate in the first through hole 312 or the second through hole 322.

It should be understood that in other embodiments, the number of the second locking portions can be two, and the number of the first locking portion can be one. The rotational gap for accommodating the first locking portion can be defined between two second locking portions, and the first locking portion can be disposed in the rotational gap between the two second locking portions. Alternatively, the number of the first locking portion and the number of the second locking portion can be one, as long as the locking member can move in the first through hole and the second through hole to drive the fifth set of teeth to define or release the meshing state of the third set of teeth and the fourth set of teeth.

In the third embodiment, the first adjusting unit 303 can have a first adjustable position and a second adjustable position. When the first adjusting unit 303 is at the first adjustable position, the locking section 3362 can penetrate through both the first through hole 312 and the second through hole 322. At the same time, the fifth set of teeth 3361 can mesh with the third set of teeth 3121 and the fourth set of teeth 3221, and the locking member 336 can lock the first locking portion 31 and the second locking portion 32 together, so that the connecting portion 30 can be in the locking state.

When the first adjusting unit 303 is at the second adjustable position, the locking section 3362 can be separated from at least one of the first through hole 312 and the second through hole 322, or the smooth section 3363 can be entirely penetrated through at least one of the first through hole 312 and the second through hole 322. At the same time, the fifth set of teeth 3361 can absolutely be separated from at least one of the third set of teeth 3121 and the fourth set of teeth 322 and release the meshing state thereof. The first locking portion 31 and the second locking portion 32 cannot be simultaneously locked by the locking section 3362, and the two are in an unlocked state. When the locking member 336 is at the second adjustable position, the first connecting member 301 can rotate relative to the second connecting member 302, and the connecting portion 30 can be unlocked.

Furthermore, in the locking member 336 in the third embodiment, a first limiting portion 3311 can be deformed at a first end of the locking section 3362 away from the smooth section 3363. An outer diameter of the first limiting portion 3311 can be larger than the inner diameter of the first through hole 312, and an edge of the first through hole 312 can abut against the first limiting portion 3311. The first adjusting unit 303 can further include a pressing member 337, which can be a ring shaped element and fixed to an end of the smooth section 3363 away from the locking section 3362 via a locking and connecting member 339. An outer diameter of the pressing member 337 can be larger than the inner diameter of the first through hole 312.

Therefore, the pressing member 337 and the first limiting portion 3311 can work together to ensure that the locking member 336 can penetrate through the first through hole 312 and the second through hole 322, thereby preventing the locking member 336 from separating from the first connecting member 301 and the second connecting member 302 and lossing.

Furthermore, the first adjusting unit 303 can further include a third elastic member 338. A first end of the third elastic member 338 can abut against an inner wall of the pressing member 337 towards the locking member 336, and a second end of the third elastic member 338 can abut against the first locking portion 31. When the first adjusting member 332 is at the first adjustable position, the third elastic member 338 can be at the compressed state, so that the third elastic member can store enough elastic shrinkage potential energy. In addition, the third elastic member 338 can have a tendency to apply elastic force on the pressing member 337 to drive the locking member 336 to move, so as to make the locking section 3362 simultaneously penetrate through the first through hole 312 and the second through hole 322, thereby making the fifth set of teeth 3361 simultaneously meshing with the third set of teeth 3121 and the fourth set of teeth 3221.

Furthermore, in the third embodiment, the third elastic member 338 can be a telescopic spring sleeved on the locking and connecting member 339 or simultaneously sleeved on the locking and connecting member 339 and the smooth section 3363. In addition, the first locking portion 31 can further be provided with a pressing groove 314 for accommodating the pressing member 337 and the third elastic member 338. A space can be defined in the pressing groove 314 and configured for pressing and moving along the axial line of the locking member 336, so that the entire pressing member 337 can be accommodated in the pressing groove 314 when the pressing member 337 is pressed. During the pressing, the third elastic member 338 can always be accommodated in the pressing groove 314. When the locking member 336 is at the first adjustable position, the first limiting portion 3311 can abut against the other first locking portion 31, and the pressing member 337 can be not higher than the edge of the pressing groove 314.

It should be understood that in other embodiments, the locking section can be in an externally prism shape. An inner wall of the first through hole and the second through hole can be an inner prism surface matching with the locking section. The locking member can move inside the first through hole and the second through hole, so as to lock or unlock the first locking portion and the second locking portion. At this time, the edges of the locking section equal to the tooth shaped convex ribs of the fifth set of teeth 3361.

In the decorating tool 100 of the third embodiment, the locking member 336 can be driven to move along the axial line of the locking member 336 by pressing, so that the locking state between the locking section 362 and the first locking portion 31 or between the locking section 362 and the second locking portion 32 can be released. In addition, when the pressing on the pressing member 337 is released, the locking member 336 can be restored under the effect of the third elastic member 338, so that the locking section 3362 and the first locking portion 31 and the second locking portion 32 can be locked again. Therefore, the connecting portion 30 can be locked and unlocked. Moreover, because the locking section 3362 meshes with the first through hole 312 and the second through hole 322, the grip portion 20 and the working portion 10 can bear an obviously larger force when locked with each other, and the first connecting member 301 and the second connecting member 302 can be not easy to slide relative to each other.

In the present disclosure, the decorating tool 100 is provided with a connecting portion 30, which defines an adjustable structure between the working portion 10 and the grip portion 10. The grip portion 20 can rotate adjacent to the working portion 10 to define an accommodation state of the decorating tool 100, which is more compact and regular in structure. When the decorating tool 100 is in the accommodation state, the decorating tool 100 can be orderly stored and occupy a smaller space; and interference between grip portions 20 of a plurality of the decorating tools 100 can be avoided, thereby increasing the quantity of the decorating tools 100 stored within the same space for shipment. The decorating tool 100 can also meet a requirement of adjusting the relative position between the grip portion 20 and working portion 10 in some workplaces and enlarge a range of application of the decorating tool 100.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A decorating tool, comprising a working portion, a grip portion and a connecting portion, wherein the working portion and the grip portion are connected to both ends of the connecting portion, respectively;

the connecting portion is configured for controlling the grip portion to rotate towards or away from the working portion; and the grip portion is rotatable towards or away from the working portion, wherein when the grip portion rotates to be adjacent to a sidewall of the working portion, the grip portion does not protrude from two ends of the working portion, wherein the connecting portion comprises a second adjusting unit, and the connecting portion is connected to the working portion via the second adjusting unit, the second adjusting unit is configured for adjusting a working angle of the decorating tool;

the second adjusting unit comprises a clamping member, a second connecting shaft, and a second adjusting member, and the working portion further comprises a supporting portion in a tube shape; the clamping member is sleeved on an outer surface of the supporting portion and capable of rotating around an axial line of the supporting portion.

2. The decorating tool of claim 1, wherein a first end of the connecting portion is connected to a middle part of the sidewall of the working portion, and a length of the grip portion is half a length of the side of the working portion.

3. The decorating tool of claim 1, wherein the connecting portion has a locking state and an unlocking state, wherein when the connecting portion is in the unlocking state, the grip portion is rotatable of rotating towards or away from the working portion; and when the connecting portion is in the locking state, the grip portion is fixed to the working portion.

4. The decorating tool of claim 3, wherein the connecting portion comprises a first locking portion, a second locking portion and a first adjusting unit, the first locking portion and the second locking portion are connected to the working portion and the grip portion, respectively, and the first adjusting unit is movably connected to the first locking portion and the second locking portion; and the first adjusting unit at least has a first adjustable position and a second adjustable position, when the first adjusting unit is at the first adjustable position, the first locking portion and the second locking portion mesh with each other to define the locking state; when the first adjusting unit is at the second adjustable position, the first locking portion and the second locking portion do not mesh with each other to define the unlocking state.

5. The decorating tool of claim 4, wherein the first locking portion is opposite to the second locking portion, a side of the first locking portion near the second locking portion is provided with a first set of teeth, a side of the second locking portion near the first locking portion is provided with a second set of teeth, which matches with the first set of teeth; and the first adjusting unit comprises a first connecting shaft and a first adjusting member, the first connecting shaft penetrates through the first locking portion and the second locking portion; the first adjusting member is movably connected to the first connecting shaft, and capable of moving relative to the first connecting shaft, so that the first locking portion and the second locking portion can be tightly mesh with each other, resulting in defining the locking state, or the first locking portion can be separated from the second locking portion, and the locking state between the first locking portion and the second locking portion is released, resulting in defining the unlocking state.

6. The decorating tool of claim 5, wherein the first adjusting member is sleeved on the first connecting shaft and threadedly connected to the first connecting shaft, the first adjusting member is capable of moving along an axial line of the first connecting shaft, so that the first locking portion and the second locking portion are tightly connected or separated from each other.

7. The decorating tool of claim 5, wherein the first adjusting member is pivotally connected to the first connecting shaft, the first adjusting member comprises a first protrusion, the first adjusting member is capable of rotating relative to the first connecting shaft and driving the first protrusion to push the first blocking portion and the second blocking portion, so that the first locking portion and the second locking portion can be tightly meshed with each other; or the first adjusting member can drive the first protrusion to move away from the first locking portion or the second locking portion, so that the first locking portion is separated from the second locking portion.

8. The decorating tool of claim 7, wherein the first adjusting unit further comprises a first elastic member, the first connecting shaft comprises a plug portion and a first limiting portion which is connected to an end of the plug portion, an outer diameter of the first limiting portion is larger than that of the plug portion; and a first end of the first elastic member abuts against the first limiting portion, and a second end of the first elastic member abuts against the first locking portion or the second locking portion.

9. The decorating tool of claim 8, wherein the first adjusting unit further comprises a gasket and a second elastic member, the second elastic member and the first elastic member have different elastic coefficients; the first elastic member, the gasket and the second elastic member are successively sleeved on the first connecting shaft; and the second end of the first elastic member abutting against the first locking portion or the second locking portion is away from the second elastic member, an end of the second elastic member away from the first elastic member abuts against the first limiting portion.

10. The decorating tool of claim 9, wherein the first locking portion or the second locking portion is provided with an accommodation groove, the first elastic member, the gasket, the second elastic member and the first limiting portion are accommodated in the accommodation groove.

11. The decorating tool of claim 7, wherein the first adjusting member further comprises a second protrusion, the second protrusion and the first protrusion are located at a same side of the first adjusting member; and the second protrusion is configured for limiting rotation of the first locking portion relative to the second locking portion when the first locking portion is tightly meshed with the second locking portion.

12. The decorating tool of claim 7, wherein the first adjusting member further comprises a warping portion, which is located at an end of the first adjusting member away from the first protrusion, and the warping portion bends along a direction opposite to the first protrusion.

13. The decorating tool of claim 4, wherein the first locking portion is provided with a first through hole, and a third set of teeth is disposed on an inner wall of the first through hole; and the second locking portion is provided with a second through hole, and a fourth set of teeth is disposed on an inner wall of the second through hole;

the first adjusting unit comprises a locking member penetrating through the first through hole and the second through hole, and a fifth set of teeth is disposed on an outer surface of the locking member, the locking member is capable of moving in the first through hole and the second through hole along an axial line of the first through hole and the second through hole, so that the fifth set of teeth mesh with both the third set of teeth and the fourth set of teeth at the same time to define the locking state; or the fifth set of teeth does not mesh with the third set of teeth and the fourth set of teeth to define the unlocking state.

14. The decorating tool of claim 13, wherein the locking member comprises a locking section and a smooth section, the fifth set of teeth is located on an outer surface of the locking section, the locking state is defined when the locking section of the locking member is arranged through the first through hole and the second through; and the unlocking state is defined when the smooth section of the locking member is arranged through the first through hole and/or the second through hole.

15. The decorating tool of claim 14, wherein the first adjusting unit further comprises a pressing member and a third elastic member, the pressing member is fixed to an end of the smooth section away from the locking section; a first end of the third elastic member is connected to the first locking portion or the second locking portion, a second end of the third elastic member opposite to the first end is configured for pushing the fifth set of teeth to mesh with both the third set of teeth and the fourth set of teeth at the same time by an elastic thrust.

16. The decorating tool of claim 1, wherein one of the clamping member and the supporting member is provided with a third through hole, the other one of the clamping member and the supporting member is provided with a slot along a circumference of the supporting portion, and the second connecting shaft penetrates through the third through hole and the slot; the second adjusting member is movably connected to the second connecting shaft and capable of moving relative to the second connecting shaft, so that the second connecting shaft is capable of moving in the slot and being fixed to different positions of inner wall of the slot.

17. The decorating tool of claim 16, wherein the supporting portion is provide with a plurality of third through holes, and the plurality of third through holes are arranged along an axial line of the supporting portion; or the supporting portion is provided with a plurality of slots, and the plurality of slots are arranged along an axial line of the supporting portion.

* * * * *